US006442779B1

(12) United States Patent
LeVert et al.

(10) Patent No.: US 6,442,779 B1
(45) Date of Patent: Sep. 3, 2002

(54) PORTABLE FEET ELEVATOR

(75) Inventors: Faye LeVert; Francis E LeVert, both of Knoxville, TN (US)

(73) Assignee: Kemp Inc., Knoxville, TN (US)

( * ) Notice: Subject to any disclaimer, the term of this patent is extended or adjusted under 35 U.S.C. 154(b) by 49 days.

(21) Appl. No.: 09/709,913

(22) Filed: Nov. 13, 2000

Related U.S. Application Data

(60) Provisional application No. 60/234,798, filed on Sep. 25, 2000.

(51) Int. Cl.[7] ..... A47C 20/02; A47C 20/04

(52) U.S. Cl. ..... 5/648; 5/710; 5/655.3

(58) Field of Search ..... 5/648, 644, 706, 5/710, 711, 713, 655.3; 128/845

(56) References Cited

U.S. PATENT DOCUMENTS

| | | | | | |
|---|---|---|---|---|---|
| 1,282,980 | A | * | 10/1918 | Takacm | 5/706 |
| 2,612,645 | A | * | 10/1952 | Boland | 5/644 |
| 3,644,949 | A | * | 2/1972 | Diamond | 5/648 |
| 5,068,933 | A | * | 12/1991 | Sexton | 5/648 |
| 5,173,979 | A | * | 12/1992 | Nennhaus | 5/648 |
| 5,476,105 | A | * | 12/1995 | Toth | 5/648 |
| 5,497,520 | A | * | 3/1996 | Kunz et al. | 5/648 |
| 5,528,783 | A | * | 6/1996 | Kunz et al. | 5/644 |
| 5,745,939 | A | * | 5/1998 | Flick et al. | 5/648 |
| 5,771,514 | A | * | 6/1998 | Wilhoit | 5/644 |

FOREIGN PATENT DOCUMENTS

| | | | | |
|---|---|---|---|---|
| CH | 643128 B | * | 5/1984 | 5/644 |

* cited by examiner

*Primary Examiner*—Alexander Grosz

(57) ABSTRACT

A variable height, portable, inflatable foot and leg elevator comprises a plurality of adjacent prismatoid chambers, cooperating to form one inflatable prismatoid-shaped resilient body adapted to support the legs and feet of a user one way valve means providing for gas transfer between said plurality of prismatoid chambers, allowing the preplanned sequential inflation of selected prismatoid chambers such that the height of said variable height portable inflatable foot and leg elevator, can be increased upon the transfer of gas through one way valve means from one chamber, to an adjacent chamber, when the gas pressure in one chamber reaches a preplanned value, sufficient to cause the opening of the way valve means; inflating means attached to a first prismatoid chamber; deflating means permanently attached to said plurality of prismatoid chambers, permitting the deflation of said chambers, to thereby decrease the height of said foot and leg elevator; power means with control means for said inflating means, and anchoring means attached to the variable height, portable, inflatable foot and leg elevator.

4 Claims, 4 Drawing Sheets

PORTABLE FEET ELEVATOR

CROSS REFERENCE OF RELATED APPLICATIONS

Pursuant to 35 U.S.C. Section 119, the benefit of priority from Provisional Application No. 60/234798 with filing date Sep. 25, 2000 is claimed for this Non-Provisional Application.

BACKGROUND OF THE INVENTION

1. Field of the Invention

This invention relates generally to situations where it is necessary to elevate the feet to reduce discomfort in the lower legs and feet of a person.

2. Status of Prior Art

There is a specialized field of medical science dealing with the use of mechanical devices that are designed to support feet and legs in the rehabilitation of injured or impaired joints and muscles. Scott, U.S. Pat. No. 5,046,487 discloses a leg elevator for use after surgical procedures. Pecheaux U.S. Pat. No. 4,323,060 and Andrews U.S. Pat. No. 4,336,796 disclosed leg and foot elevators for the postoperative period. These devices unlike that of Engleman, U.S. Pat. No. 5,725,486 are intended for specific applications and taught a leg elevator that is useful in all applications where the leg is immobilized. None of these devices are designed for general applications where a user simply desires to elevate the feet to minimize discomfort caused by edema or swelling of the feet and lower legs after hours of being ambulatory. There is a need for apparatuses that are portable and in general useful for general relief for user with swelling feet, legs etc. Jackson, Design U.S. Pat. No. 416,428 disclosed an ornamental design for an inflatable orthopedic pillar with aperture that is useful for orthopedic applications. Though not specifically designed for elevating the foot, Raftery, U.S. Pat. No. 5,432,967 disclosed a multiple position resilient support cushion that could be formed from foam material or an air inflatable bladder. The apparatus of Raftery unlike that of Johnson was designed to support the head and body of the user when in a lying, sitting and in an in-between resting position. Both these apparatuses when deployed provides the user with one fixed height for elevating the feet and legs region of the body. The operating height is not selectable by the user during use for the most comfort or therapeutic effect.

It is an object of this invention to provide a portable appliance that can used to elevate the feet and lower region of the human body so as to serve to reduce the edema and swelling of the lower body extremities.

It is a further object of this invention to provide an inflatable prismoid shaped feet and legs elevator.

Still another object of this invention is to provide a foot elevator that provides support for the Achilles tendons, lower legs and feet.

It is an additional object of this invention to provide a leg and foot elevator that can be deployed by the user from a lying, sitting or an in-between resting position.

Yet another object of the invention is to provide a foot elevator with selectable levels of elevation.

These and other objects will become apparent during the course of the detailed description of the apparatus of this invention.

SUMMARY OF THE INVENTION

An air impervious material for use in the assembly of an inflatable foot and leg elevator designed to be applicable to situations where it is necessary to eliminate discomfort in the feet and lower leg regions of the body by elevating the feet above a plane that is coplanar with the axial center of a lying human body. The foot and leg elevator comprising: an inflatable material that describes a compound prismoid when deployed, a gas pump for inflating the foot elevator, a valve through which the inflating gas is introduced into the inner volume of the elevator and a non-slip mechanism to prevent the inadvertent displacement of the foot elevator during use.

DETAILED LIST OF FIGURES

DETAILED DESCRIPTION OF THE INVENTION

Figure 1:
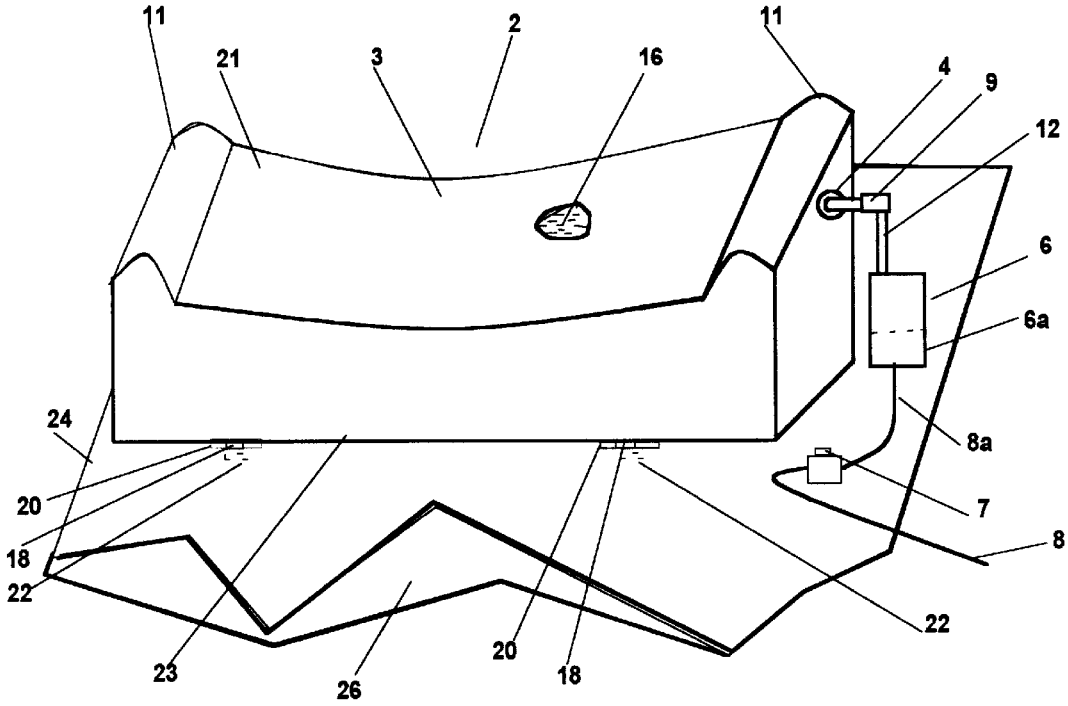
FIG. 1 is a front view of the apparatus of the first embodiment of this invention.

Referring now to the figures, and more particularly to FIG. 1, a sketch according to one embodiment of the present invention is shown as referenced by the numeral 2. The inflatable prismoid shaped foot elevator 2 (hereafter referred to as FE 2), when fully inflated, is designed to support the feet, legs and knees in a manner so as to achieve a substantially gradual increase in the elevation of the legs relative to the knees and the feet relative to the legs as one moves along the legs in a horizontal direction. Additionally, FE 2 is designed to provide concaved first surface such that the feet tend to migrate under the force of gravity toward the center of the FE 2 away from its lateral edges, which exhibits rounded protrusions 11. The material of construction of the FE 2 may be plastic, rubber or other non-porous materials. For example, the construction material may be woven polymeric material treated so as to make it impervious to air leakage when used to form a bladder. Additionally, the material of construction could just as well be covered with a textured woven or unwoven cloth such that FE 2 could have a plastic bladder covered with cloths of various textures and feel. In FIG. 1, the inflatable FE 2 is inflated by electrically activating pump 6, which is connected to FE 2 by way of Schrader valve 4, detachable non-leak connector 9 and flexible tube 12. Schrader valve 4 is designed to prevent the back flow of pressurized air 16 from the interior of an inflated FE 2. While the apparatus of this invention utilized a Schrader valve, a self-sealing check valve could have been used to inject the gas into the interior of the FE 2. The control of the OFF/ON status of the pump 6 is accomplished through switch 7, which is electrically attached to power cord 8 and electrical, leads 8*a*. The power cord 8 is connected to the ordinary alternating or direct current source not shown in FIG. 1. In the device of this invention, the output voltage of an ordinary 120-volt alternating current (AC) source was converted to via an ordinary linear transformer and standard signal rectification circuitry to a 12-volt direct current source 6*a* that was used to power the air pump 6. The 12-volt direct current source 6*a* could just as well been an ordinary AC adapter. The direct current voltage, which was derived from a normal 120 alternating current voltage source could have just as well been obtained by using a direct current supply, which utilize low voltage dry cell batteries coupled to a step-up direct current-to-direct current converter. The latter, which converts the voltage potential of the series connected batteries to a 12 volt direct current voltage, could be used to power the air pump 6. Magnet buttons 18 are attached to the second surface 23 of the inflatable FE 2 as by pouches 20. Retaining magnet buttons 22 are placed beneath the surface of cover 24, which is used to cover the surface (not shown) on which a user may be reclining. The retaining magnets 22 when magnetically attached to magnet buttons 18 with covering 24 therebetween prevents foot elevator 2 from slipping on a surface during use because the captured covering 24 acts as an anchor once a weight or body is place thereupon. The source of air for pressurization of the inflatable FE 2 in the first embodiment is an ordinary pump. It could, however, be a small container of pressurized air or other mechanical sources of pressurizing air. The pressure of the air inside the FE 2 must be such that it can withstand a substantial load positioned on first surface 21 without collapsing. A load of 80 pounds was used during the testing of the invention. Additionally, the material of construction of FE 2 must be capable of sustaining a high internal gas pressure without leaking. The Schrader valve 4 is used to provide the aperture for inflating the FE 2 and also to permit the deflation of the FE 2 after use.

Figure 2:
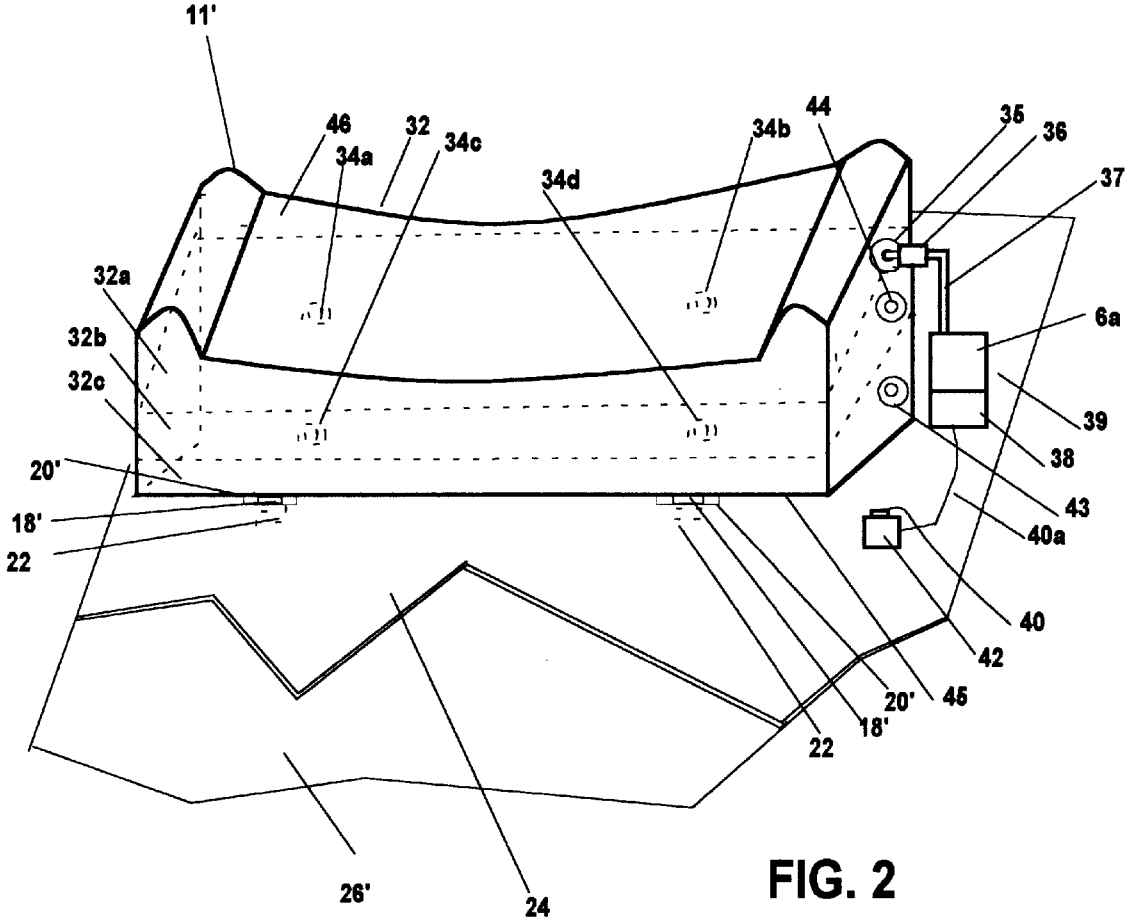
FIG. 2 is a front view of the second embodiment of the device of this invention.
Figure 3:
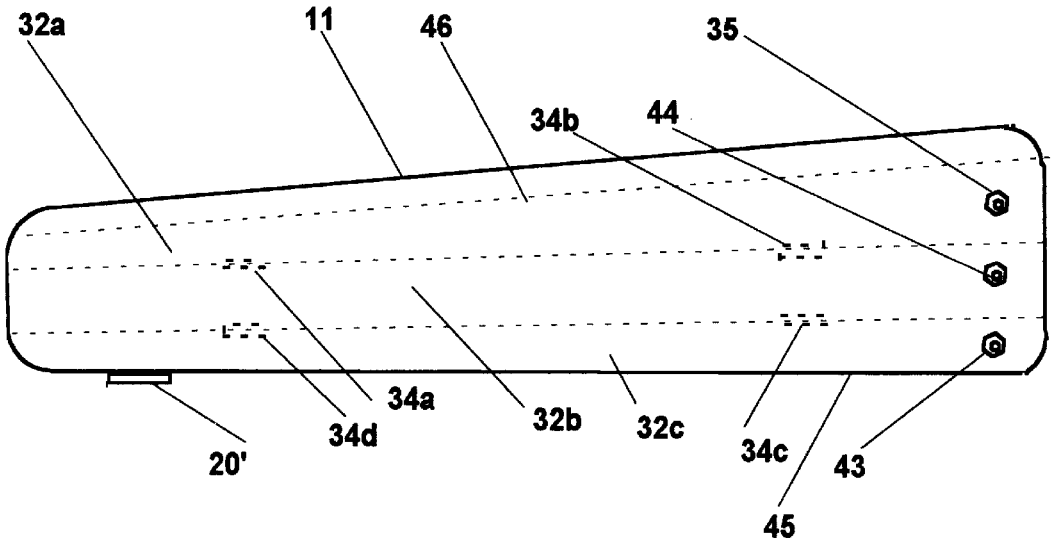
FIG. 3 is a side view of the apparatus of the second embodiment of the device of this invention fully inflated.

FIG. 2 shows the second embodiment of the device of this invention. The inflatable prismoid foot elevator 32 of the second embodiment consists of prismoidal compartments 32*a*, 32*b* and 32*c*, which are prevented from prematurely communicating with each other by check valves 34*a*, 34*b*, 34*c* and 34*d*. That is, check valves 34*a* and 34*b* are designed to open only when the air pressure in the upper compartment 32*a* reaches a prescribed pressure at which the check valves 34*a* and 34*b* are designed to open so that the second compartment may be pressurized. Likewise, check valves 34*c* and 34*d* allow the flow of air into compartment 32*c* once compartment 32*b* reaches a prescribed pressure. With all three compartments (i.e., 32*a*, 32*b* and 32*c*) fully inflated prismoid foot elevator 32 peak height is substantially equal to or greater than 15 inches. Therefore, if only compartment 32*a* is fully inflated the operating height will be substantially less than 15 inches. The foot elevator 32 may be deflated via check valves 43, 44 and 35. The inflatable foot elevator 32 in FIG. 2 is shown as it would be deployed on surface 26. The magnets 18' are attached to second surface 45 of foot elevator 32 via pouches 20'. The prismoid foot elevator 32 has a single filling check valve 35 that is connected to compartment 32*a*. Connector 36 is used to couple, with leak free certainty, tubing 37 which mechanically connects air pump—direct current power supply system 39 to check valve 35 which is attached to prismoid foot elevator 32 via Schrader valve 36. The pump 6*a* of FIG. 2 is electrically connected to the battery powered direct current power supply 38, of the air pump-direct current power supply system 39. The on/off state of direct current supply 38 is controlled by switch 40, which is located on housing 42. The switch 40 is electrically connected to the battery powered direct current supply 38 via electrical lead 40*a* which is electrically connected to pump 6*a*. In this second embodiment of the feet elevator, the control switch 40 is electrically connected to battery power direct current supply 38 by electrical lead 40*a*, it however, could have been the transmitter portion of a wireless controller that accessed a receiver located in pump direct current power supply 39. The first surface 46 of compartment 32*a* of prismatoid foot elevator 32 has a curvature that causes that portion of the body to normally settle in the cusp of the surface. Though not shown, the first surface 46 has undulations that also help to stabilize that portion of the body in contact therewith by causing it to move toward the center of the prismatoid foot elevator 32 first surface 46. The compartments 32*b* and 32*c* of foot elevator 32 are equipped with check valve 43 and 44 which along with Schrader valve 35 are used to deflate the foot elevator 32 after use. While the devices of the first and second embodiments of this invention utilized check valves and Schrader valves, they could just as well made use of other valves. Also, the tubing 37 could be seamlessly connected to check valve 35 without the use of an intervening connector. FIG. 3 shows a side view of the apparatus of the second embodiment of the foot and leg elevator. When thoroughly deflated the collapsed feet elevator 32, pump-direct current supply system 39 and switch 40 in housing 42 are designed to fit in a simple carrying case.

Figure 4:
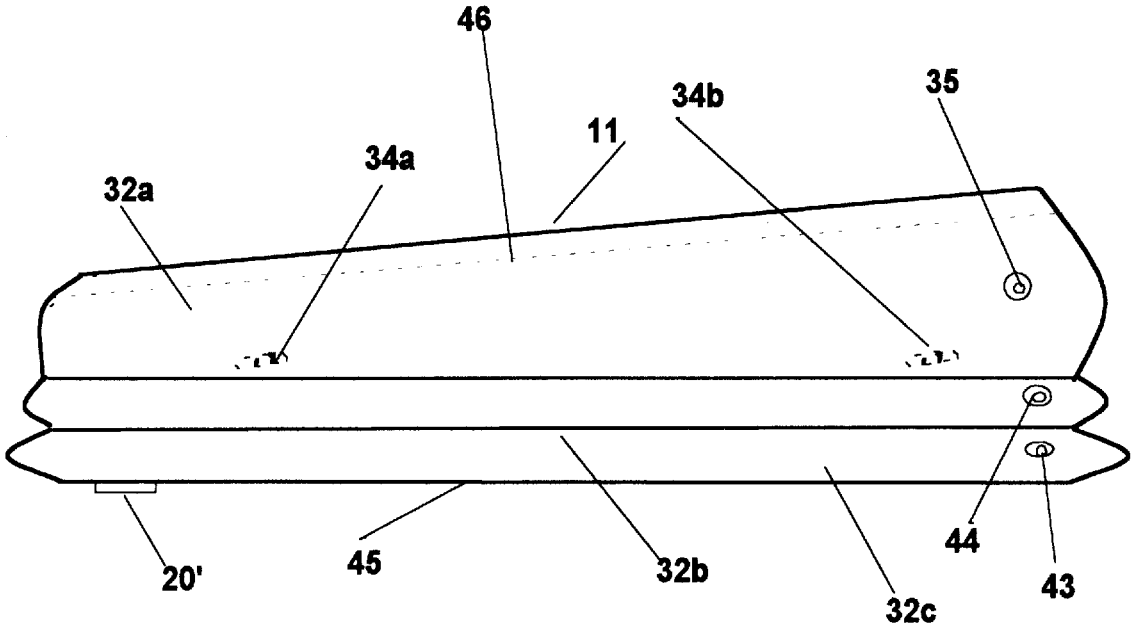
FIG. 4 is a side view of the apparatus of the second embodiment of the device of this invention partially deployed.

The operation of prismatoid FE 2 of the first embodiment will now be explained. When the inflatable prismatoid FE 2 is deployed on a surface, the covering 24, on which the user or some other stabilizing element rest, can be placed between the magnet buttons 18 and the retaining magnets 22 as shown in FIGS. 1 and 2. The button magnets 18 and retaining magnets 22 may be made of ceramic magnets such as neodymium, cobalt or other high magnetic field strength materials. After deployment on a surface, the covering 24 having a stabilizing element such as a body or weight (not shown in FIGS. 1 or 2) thereupon is captured between the two pairs of magnets, they will provide non-slip positioning of the foot elevator of the first and second embodiments of this invention. When the pump 6 is mechanically coupled to tube 12 which is in term connected to the Schrader valve 4, FE 2 can be inflated to a comfortable height by controlling the OFF/ON position of handheld switch 7 which controls the off/on state of a suitable power supply that is compatible with the air pump while the user has his/her feet positioned on the foot elevator. With the feet and legs in place on FE 2, the switch 7 is used to place the suitable power source in an off state once the desired elevator height is achieved FIG. 4 shows a side view of the device of the second embodiment of the device of this invention partially deployed with the compartment 32*a* pressurized to a pressure just below that required to actuate check valves 34*a*(not shown) and 34*b* such that compartment 32*b* may be automatically inflated.

Thus as described above, and seen in FIGS. 2–4 the invention comprises a variable height, portable, inflatable foot and leg elevator, a plurality of adjacent prismatoid chambers, cooperating to form one inflatable prismatoid-shaped resilient body adapted to support the legs and feet of a user; one way valve means providing for gas transfer between said plurality of prismatoid chambers, allowing the preplanned sequential inflation of selected prismatoid chambers such that the height of said variable height portable inflatable foot and leg elevator can be increased upon the transfer of gas through one way valve means from one chamber, to an adjacent chamber, when the gas pressure in one chamber reaches a preplanned value, sufficient to cause the opening of the way valve means; inflating means attached to a first prismatoid chamber; deflating means permanently attached to said plurality of prismatoid chambers, permitting the deflation of said chambers, to thereby decrease the height of said foot and leg elevator; power means with control means for said inflating means, and anchoring means attached to the variable height, portable, inflatable foot and leg elevator.

The feet elevators of the first and second embodiments of this invention is here described as an inflatable apparatus having a prismatoid shape. They could, however, have one of many different three-dimensional shapes. Also, the magnets of the feet elevators could be replaced by hoop and loop Velcro pairs.

Other variations will be readily apparent to those of ordinary skill in the art. The foregoing is not intended to be an exhaustive list of modifications but rather is given by way of example. It is understood that it is in no way limited to the above embodiments, but is capable of numerous modifications within the scope of the following claims.

Having thus described the aforementioned invention, we claim:

1. A variable height, portable, inflatable foot and leg elevator comprising;

a plurality of adjacent prismatoid chambers, cooperating to form one inflatable prismatoid-shaped resilient body adapted to support the legs and feet of a user;

one way valve means providing for gas transfer between said plurality of prismatoid chambers, allowing the preplanned sequential inflation of selected prismatoid chambers such that the height of said variable height portable inflatable foot and leg elevator, can be increased upon the transfer of gas through one way valve means from one chamber, to an adjacent chamber, when the gas pressure in one chamber reaches a preplanued value, sufficient to cause the opening of the one way valve means;

inflating means attached to a first prismatoid chamber;

deflating means permanently attached to said plurality of prismatoid chambers, permitting the deflation of said chambers, to thereby decrease the height of said foot and leg elevator;

power means with control means for said inflating means, and anchoring means attached to the variable height, portable, inflatable foot and leg elevator.

2. The foot and leg elevator of claim 1, wherein the anchoring means comprises magnetic means.

3. The foot and leg elevator of claim 1, wherein the power means comprises dry cell batteries.

4. The foot and leg elevator of claim 1, wherein the deflating means comprises check valves.

* * * * *